US006216288B1

(12) United States Patent
Bernau

(10) Patent No.: US 6,216,288 B1
(45) Date of Patent: Apr. 17, 2001

(54) SEAL FOR BATHTUB OVERFLOW DRAIN

(76) Inventor: Barry Bernau, 45288 Ashwood Ct., Utica, MI (US) 48317

( * ) Notice: Subject to any disclaimer, the term of this patent is extended or adjusted under 35 U.S.C. 154(b) by 0 days.

(21) Appl. No.: 09/417,799

(22) Filed: Oct. 14, 1999

(51) Int. Cl.[7] ..... E03C 1/244
(52) U.S. Cl. ..... 4/694; 4/680
(58) Field of Search ..... 4/694, 680, 651

(56) References Cited

U.S. PATENT DOCUMENTS

| | | | |
|---|---|---|---|
| D. 305,455 | 1/1990 | Stairs, Jr. | D23/254 |
| 379,973 | 3/1888 | Moore | 4/694 |
| 1,235,387 | 7/1917 | Serper | 4/694 |
| 1,598,162 | 8/1926 | Solomon | 4/694 |
| 2,113,043 | 4/1938 | Ehrhorn | 4/694 |
| 2,398,921 | 4/1946 | Cook | 4/694 |
| 3,497,878 | 3/1970 | Emery | 4/694 |
| 3,570,020 | 3/1971 | Kato | 4/694 |
| 3,927,428 | 12/1975 | Jette et al. | 4/694 |
| 5,025,509 | 6/1991 | Holt et al. | 4/694 |
| 5,330,811 | 7/1994 | Buchalter | 4/650 X |

*Primary Examiner*—Henry J. Recla
*Assistant Examiner*—Kathleen J. Prunner
(74) *Attorney, Agent, or Firm*—Harness, Dickey & Pierce, PLC

(57) ABSTRACT

A sealing member is provided for a bathtub. A conventional plate is coupled to the wall of a bathtub and covers a drain opening formed therein. The plate is continuous except for an overflow opening which accommodates the free flow of water from the bathtub through the drain opening and down the overflow drain of the bathtub. The sealing member sealingly engages the plate and the bathtub wall to prevent water from flowing through the overflow opening of the plate and down the overflow drain of the bathtub. The sealing member includes an annular lip which fits snugly within the overflow opening of the plate. In an alternate embodiment, a bypass opening is formed in the sealing member at a height greater than that of the overflow opening of the plate. A channel formed within the sealing member extends between the bypass opening and the overflow drain. Water may then enter the sealing member at a height greater than the overflow opening and be channeled through the overflow drain and out of the bathtub.

20 Claims, 2 Drawing Sheets

FIG. 1.
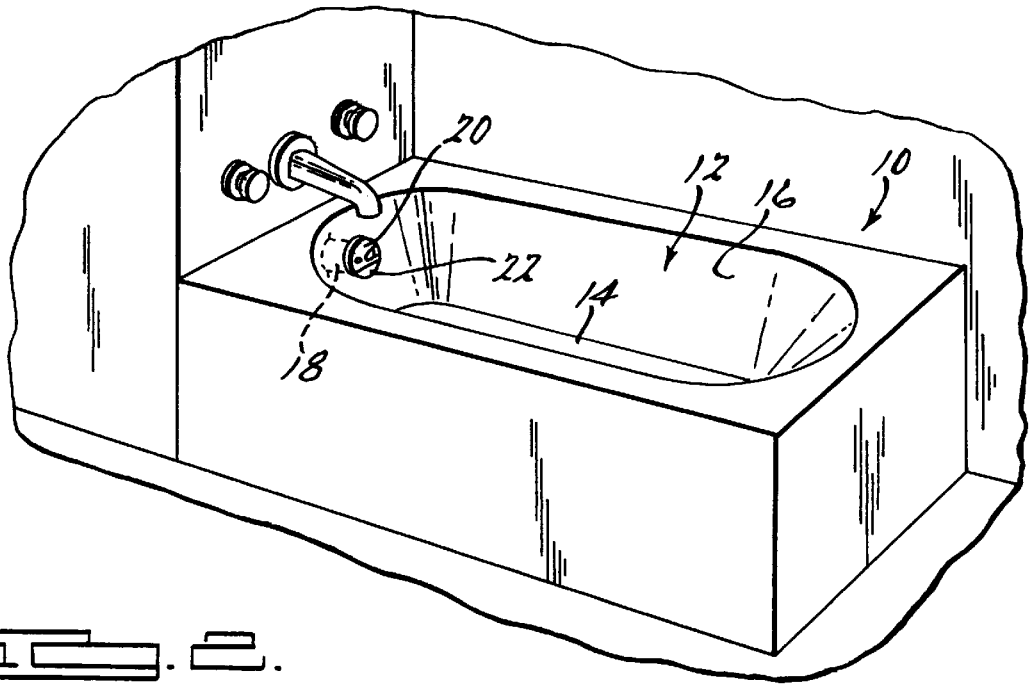
FIG. 2.
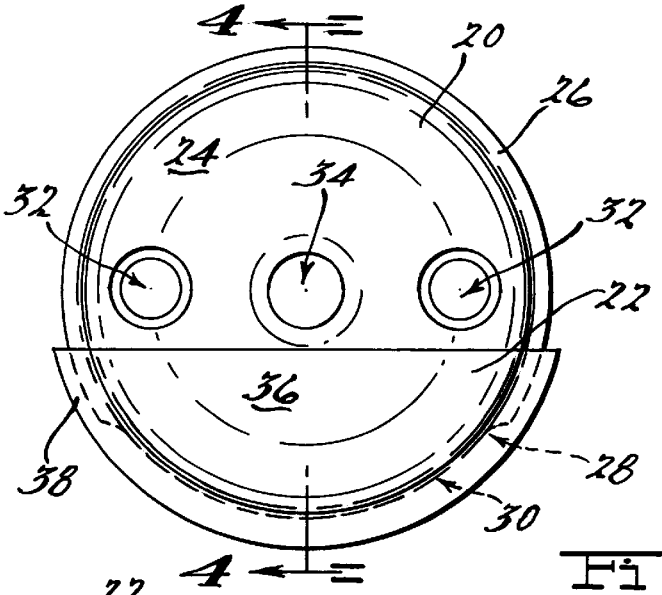
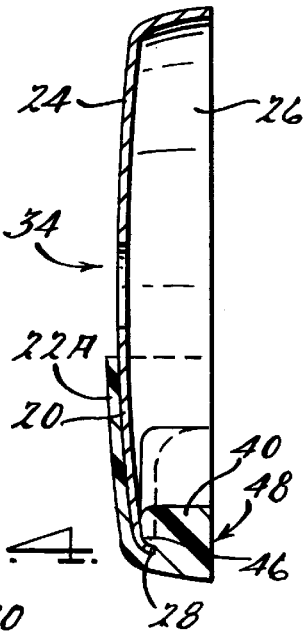
FIG. 4.
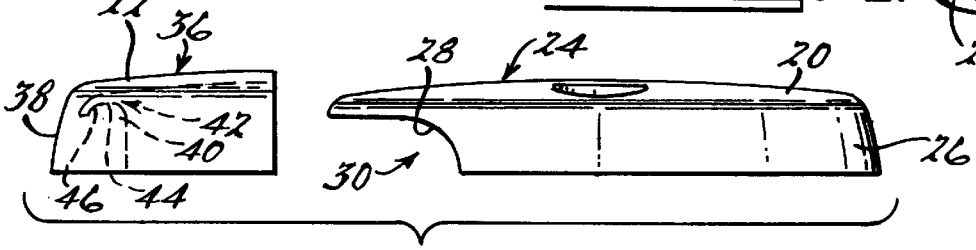
FIG. 3.

SEAL FOR BATHTUB OVERFLOW DRAIN

BACKGROUND OF THE INVENTION

1. Technical Field

The present invention generally relates to bathtubs and, more particularly, relates to an apparatus for increasing the capacity of a bathtub.

2. Discussion

The inner volume of a bathtub is defined by a plurality of vertical walls. One of these walls includes an overflow drain opening formed therein. The overflow drain prevents the bathtub from overflowing by providing an outlet for water at a level near the top of the inner tub area.

It is known in the art to utilize a metal plate or escutcheon to conceal the overflow drain without completely sealing it. These plates or escutcheons typically are designed to cover overflow drains virtually in their entirety, but include an opening in a lower portion. The opening enables water to exit the bathtub and enter the overflow drain.

As is generally known, when a person enters a partially filled bathtub, water is displaced and the water level rises. On occasion, this displacement causes the water to rise to a level higher than the overflow drain. When this occurs, water channels through the plate opening and exits the tub through the overflow drain. The water level is thereby maintained at a maximum level which is even with the lowest portion of the overflow drain. For many people, this water level undesirably leaves portions of the body uncovered.

Existing devices have been designed for the purpose of increasing the capacity of water that a bathtub can hold without losing any water through the overflow drain. However, these devices have certain disadvantages. In some cases, bulky fixtures must be attached to the bathtub with mechanical fasteners. These devices typically require tools to be engaged and disengaged and include large protrusions which protrude into the bathing area. In other cases, devices seal against the wall of the bath tub and completely surround the plate or escutcheon which conceals the overflow drain. These designs are excessively large and unnecessarily protrude into the bathing area.

In view of the foregoing, it would be desirable to provide an apparatus for increasing the capacity of water that a bathtub can hold without losing any water through the overflow drain that does not require tools for engagement or disengagement and only minimally protrudes into the bathing area of the bathtub.

SUMMARY OF THE INVENTION

The above and other objects are provided by a sealing member for a bathtub. According to the invention, a conventional plate is coupled to the wall of a bathtub and covers a drain opening formed therein. The plate is continuous except for an overflow opening which accommodates the free flow of water from the bathtub through the drain opening and down the overflow drain of the bathtub. The sealing member sealingly engages the plate and the bathtub wall to prevent water from flowing through the overflow opening of the plate and down the overflow drain of the bathtub. The sealing member includes an annular lip which fits snugly within the overflow opening of the plate. This advantageously allows for engagement and disengagement of the sealing member without the need for tools. In an alternate embodiment, a magnet is used to enhance the attachment of the bypass member to the plate. In another alternate embodiment, a bypass opening is formed in the sealing member at a height greater than that of the overflow opening of the plate. A channel formed within the sealing member extends between the bypass opening and the overflow drain. Water may then enter the sealing member at a height greater than the overflow opening and be channeled through the overflow drain and out of the bathtub.

BRIEF DESCRIPTION OF THE DRAWINGS

In order to appreciate the manner in which the advantages and objects of the invention are obtained, a more particular description of the invention will be rendered by reference to specific embodiments thereof which are illustrated in appended drawings. Understand that these drawings only depict preferred embodiments of the present invention and are not therefore to be considered limiting in scope, the invention will be described and explained with additional specificity and detail through the use of accompanying drawings in which:

FIG. 1 is an perspective view of a bathtub illustrating the bathtub assembly of the present invention;

FIG. 2 is a plan view of the plate and sealing member of the bathtub assembly of the present invention;

FIG. 3 is an exploded side view of the plate and sealing member of the bathtub assembly of the present invention;

FIG. 4 is a cross-sectional view of the plate and a sealing member according to a first alternate embodiment of the present invention;

DETAILED DESCRIPTION OF THE PREFERRED EMBODIMENTS

Figure 5:
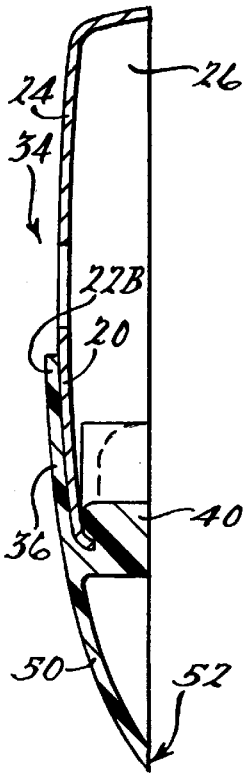
FIG. 5 is a cross-sectional view of a plate and a sealing member according to a second alternate embodiment of the present invention.

The present invention is directed towards a bathtub assembly for increasing a capacity of the tub. The bathtub assembly includes a plate covering a drain opening in the tub except for an overflow opening in the lower portion thereof. A sealing member is sealingly engaged to the edges of the plate adjacent the overflow opening, the wall of the bathtub, and the major surface of the plate itself. When engaged to the plate, the sealing member prevents fluid from exiting the tub through the drain opening. Advantageously, the sealing member of the present invention can be quickly engaged and disengaged from the plate and only minimally protrudes into the bathing area of the tub.

Turning now to the drawings, FIG. 1 illustrates a perspective view of a bathtub 10 incorporating the teachings of a preferred embodiment of the present invention. Although bathtub 10 is illustrated, it is to be understood that this configuration is merely exemplary of the type of apparatus in which the present invention could be employed. Bathtub 10 includes an inner volume 12 defined by a base or floor 14 and a continues inner wall 16 which extends vertically relative to the base 14. An overflow drain 18 is formed in the wall 16 and terminates at a height vertically spaced apart from the base 14. The overflow drain 16 provides a passage for the escape of fluid from the bathtub 10 prior to it overflowing the wall 16. A circular plate 20 is secured to the wall 16 adjacent the overflow drain 18 so as to conceal the same. A sealing member 22 sealingly engages the plate 20 and the wall 16. As will become apparent from the description below, an important feature of the present invention is that sealing member 22 is designed to engage the plate 20 in a way sufficient to secure the sealing member 22 to plate 20 and to create a seal capable of preventing water from entering the overflow drain 18.

Turning now to FIGS. 2 and 3, more detailed views of the plate 20 and sealing member 22 are illustrated. Plate 20 includes a circular base portion 24 which is essentially planar or slightly convex and an annular skirt 26 axially projecting from a perimeter thereof. Annular skirt 26 includes a generally U-shaped recessed edge 28 which defines a boundary of an overflow opening 30. As is known in the art, a pair of screw holes 32 in base 24 accommodate attachment screws (not shown) for securing the plate 20 to the bathtub 10 (see FIG. 1) and a toggle hole 34 accommodates a drain toggle (not shown) for opening and closing a main drain of the tub. When the drain toggle and attachment screws are in place, screw holes 32 and toggle hole 34 are sealed and prevent water from passing there through.

Sealing member 22 includes a semicircular body 36 which is essentially planar or slightly convex to compliment the shape of the base 24. A radiused side wall 38 is integrally formed with the body 36 and axially projects therefrom. An arcuate lip 40 is integrally formed with the body 36 and axially projects therefrom in spaced relation to the side wall 38. The particular configuration of the lip 40, including the radius of curvature and axial dimension, is selected to complement the recessed edge 28 of the plate 20 so that a sealing engagement may be effected therebetween.

When sealing member 22 is engaged to plate 20, sealing member body 36 frictionally engages plate base 24, radiused side wall 38 engages plate annular skirt 26, and arcuate lip 40 engages wall 12 of bathtub 10 (see FIG. 1) and recessed edge 28 adjacent plate overflow opening 30. When sealing member 22 is in this engaged position, a complete seal is created between sealing member 22, plate 20 and wall 12 such that water is prevented from flowing through overflow opening 30. Thus, sealing member 22 is designed to engage wall 12 of bathtub 10 and recessed edge 28 adjacent overflow opening 30 in a way sufficient to secure sealing member 22 to plate 20 and to create a seal capable of preventing water from entering the opening in plate 20. As will become apparent from the further description below, these design goals for sealing member 22 may be achieved by several different alternate preferred embodiments.

As best seen in FIG. 3, arcuate lip 40 and body 36 are spaced apart to define a channel 42 for accommodating recessed edge 28 of plate 20. The lip 40 includes a planar surface 44 opposite the body 36 and a shoulder 46 opposite the side wall 38. When recessed edge 28 engages lip 40 and body 36, sealing bypass member 22 is secured to plate 20 and a complete seal is formed for preventing water from flowing behind plate 20.

Turning now to FIG. 4, a cross-sectional side view of a first alternate embodiment sealing member 22A is illustrated with plate 20. In this embodiment, the shoulder 46 is formed as an overhang to enhance the connection between recessed edge 28 and lip 40. Further, lip wall 48 is planar so as to sealingly engage wall 12 of bathtub 10 (see FIG. 1). This prevents water from flowing behind plate 20.

Turning now to FIG. 5, a cross-sectional side view of plate 20 and a sealing member 22B of a second alternate preferred embodiment of the present invention is illustrated. Sealing member 22B includes an arm 50 integrally formed with body 36 and radially projecting therefrom. Arm 50 forms an overhang which is forced toward wall 12 of bathtub 10 under the pressure of water. The edge 52 of arm 50 creates an additional seal which assists arcuate lip 40 in preventing water from flowing behind plate 20. When wall 12 is engaged by lip 40 and edge 52, a double seal arrangement is created.

Figure 6:
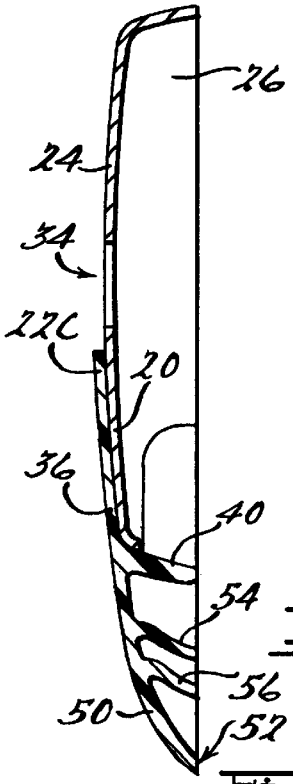
FIG. 6 is a cross-sectional view of a plate and a sealing member according to a third alternate embodiment of the present invention.

Turning now to FIG. 6, a cross-sectional side view of a plate 20 and a sealing member 22C of a third alternate preferred embodiment of the present invention is illustrated. Sealing member 22C includes first and second sealing fingers 54 and 56 projecting from the arm 50. First and second sealing fingers 54 and 56 engage wall 12 of bathtub 10 to enhance the seal to prevent water from flowing behind plate 20.

Figure 7:
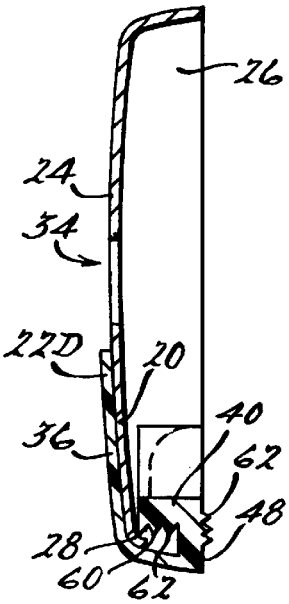
FIG. 7 is a cross-sectional view of a plate and a sealing member according to a fourth alternate embodiment of the present invention.

Turning now to FIG. 7, a cross-sectional side view of a plate 20 and a sealing member 22D of a fourth alternate preferred embodiment of the present invention is illustrated. First lip wall 48 of arcuate lip 40, which is essentially parallel to the body 36, and second lip wall 60, which is essentially perpendicular to the first lip wall 48, include a plurality of projections 62 orthogonally extending therefrom in the form of teeth. It will be appreciated that these teeth preferably include a cross-sectional shape which is triangular in nature. The projections preferably are elongated and shaped to complement the curve of the lip 40. The teeth on first lip wall 48 engage wall 12 and create a series of seals which prevent water from flowing behind plate 20. The teeth on second lip wall 60 engage recessed edge 28 to frictionally secure sealing member 22D to plate 20. In addition, arcuate lip 40 engages plate 20 and assists in the creation of a seal.

Figure 8:
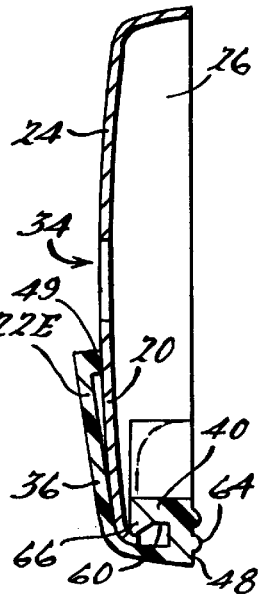
FIG. 8 is a cross-sectional view of a plate and a sealing member according to a fifth alternate embodiment of the present invention.

Turning now to FIG.8, a cross-sectional side view of a plate 20 and a sealing member 22E according to a fifth alternate preferred embodiment of the present invention is illustrated. First lip wall 48 of arcuate lip 40 and second lip wall 60 are oriented as with the previous embodiment. First lip wall 48 includes a plurality of projections 64 extending therefrom in the form of nodes. It will be appreciated that these nodes preferably include a cross-sectional shape which is semicircular in nature. The projections are preferably elongated and shaped to compliment the curve of the lip 40. The nodes on first lip wall 48 engage wall 12 to create a series of seals which prevent water from flowing behind plate 20. Second lip wall 60 terminates in a tooth 66 for engaging recessed edge 28 and securing sealing member 22E to plate 20. In addition, arcuate lip 40 engages plate 20 and assists in the creation of a seal. In addition, the body 36 of the sealing member 22E includes a laterally projecting lip 49. The lip 49 engages the base 24 so as to ensure a complete seal therebetween.

Figure 9:
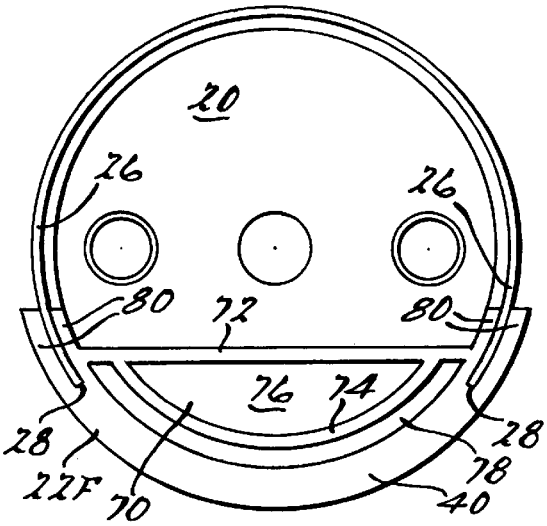
FIG. 9 is a bottom view of a plate and a sealing member according to a sixth alternate embodiment of the present invention.

Turning now to FIG. 9, a bottom view of plate 20 and a sealing member 22F according to a sixth alternate preferred embodiment of the present invention is illustrated. Sealing member 22F includes a rear wall 70 which engages the back side of plate 20. Rear wall 70 of sealing member 22F has a first sealing member 72 axially projecting therefrom opposite the plate 20. The sealing member 22F also includes an arcuate second sealing member 74 axially projecting therefrom and extending from the first sealing member 72. The second sealing member 74 is preferably shaped to compliment the curve of the lip 40. A first recessed portion 76 is defined between the first and second sealing members 72 and 74 while a second recessed portion 78 is defined between the second sealing member 74 and lip 40.

First sealing member 72 of sealing member 22F spans the diameter of the plate 20 and engages wall 12 and plate 20 to create a first seal for preventing water from flowing behind plate 20. First recessed portion 76 of sealing member 22F engages plate 20 to connect sealing member 22F to plate 20. Second sealing member 74 extends semicircularly from one end of first sealing member 72 to a second, spaced-apart end of first sealing member 72. Second sealing member 74 engages wall 12 and plate 20 to create a second seal for preventing water from flowing behind plate 20. Lip 40 engages recessed edge 28 and wall 12 to create a third seal for preventing water from flowing behind plate 20. Lip 40 is bifurcated at its ends into a pair of spaced apart fingers or split flanges80 which engage both sides of annular skirt 26 to secure sealing member 22F to plate 20.

Figure 10:
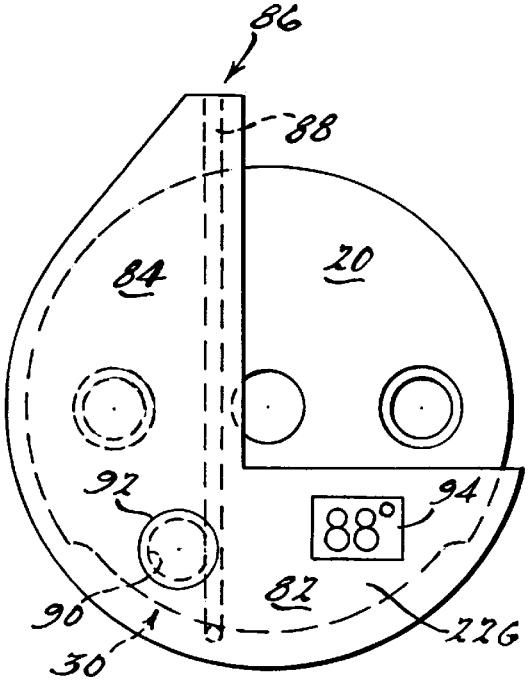
FIG. 10 is a plan view of a plate and a sealing member according to a seventh alternate embodiment of the present invention.

Turning now to FIG. 10, a plan view of plate 20 and a sealing member 22G according to a seventh alternate preferred embodiment of the present invention is illustrated. Sealing member 22G is generally L-shaped and includes a base portion 82 and an extension member 84 generally perpendicular thereto. A bypass opening 86 is located at the top of extension member 84 and opens into a channel 88 formed within the sealing member 22G. Channel 88 leads to overflow opening 30 in plate 20. When the water in tub 10 reaches a level above bypass opening 86, water enters the opening, travels down channel 88, enters overflow opening 30, and exits down the drain and out of the bathtub. The benefit of this embodiment is that the water level is allowed to rise over the level of overflow opening 30 before water begins draining out the overflow drain. However, the tub is still drained before it overflows. This allows the water level to rise above the overflow opening without completely losing the benefit of the drain overflow protection device. Advantageously, the height of the extension member 84 may be selected to effectuate different drain levels.

Also, the sealing member 22G includes an aperture 90 formed therein communicating with the channel 88. The aperture 90 is sealed with a removable plug 92. If desired, the plug 92 may be removed to allow draining through the sealing member 22G via the aperture 90. A temperature gauge 94 may also be incorporated into the sealing member 22G if desired.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A sealing assembly for a drain opening in a bathtub comprising:

an escutcheon adapted to be coupled to a wall of said bathtub and covering said drain opening formed therein;

said escutcheon including an overflow opening therein adapted to be fluidly communicating with said drain opening; and a sealing member adapted to be sealingly engage said wall and said escutcheon to prevent fluid flow into said overflow and drain openings.

2. The sealing assembly of claim 1, wherein said sealing member includes a bypass opening formed therein at a height greater than that of said overflow opening, said bypass opening communicating with said overflow opening.

3. The sealing assembly of claim 1, wherein said escutcheon further comprises a base having an annular skirt axially projecting therefrom, said skirt including a recessed edge forming said overflow opening.

4. The sealing assembly of claim 3, wherein said sealing member includes an arcuate lip engaging said recessed edge.

5. The sealing assembly of claim 3, wherein said sealing member includes a radiused sidewall engaging said annular skirt.

6. The sealing assembly of claim 3, wherein said sealing member includes a body engaging said base of said escutcheon.

7. The sealing assembly of claim 3, wherein said sealing member further comprises at least one split flange engaging said base of said escutcheon and securing said sealing member thereto.

8. A sealing assembly for sealing an overflow opening in a drain plate of a bathtub, the sealing assembly comprising:

a body portion adapted to engage said drain plate;

a side wall integrally formed with said body portion and axially projecting therefrom, said side wall adapted to engage said drain plate; and a lip integrally formed with said body portion and axially projecting therefrom, said lip adapted to engage said drain plate so as to prevent fluid communication through said overflow opening.

9. The sealing assembly of claim 8, wherein said body portion is substantially semicircular and is adapted to compliment a base portion of said drain plate.

10. The sealing assembly of claim 8, wherein said side wall is radiused and is adapted to compliment an annular skirt portion of said drain plate.

11. The sealing assembly of claim 8, wherein said lip is arcuate and axially projects from said body portion in spaced relation to said side wall, said lip being adapted to compliment a recessed edge of said drain plate so that a seal may be formed therebetween when said sealing assembly engages said drain plate.

12. The sealing assembly of claim 8, wherein said body portion further includes an arm integrally formed therewith and radially projecting therefrom, said arm including an edge adapted to engage a bathtub wall to assist in preventing fluid communication through said overflow opening.

13. The sealing assembly of claim 12, wherein said arm further includes at least one sealing finger projecting therefrom, said sealing finger having an edge adapted to engage said bathtub wall and to assist in preventing fluid communication through said overflow opening.

14. The sealing assembly of claim 8, wherein said lip further includes first and second walls, said first lip wall being substantially parallel to said body portion and including a plurality of teeth orthogonally extending therefrom, said second lip wall being substantially perpendicular to said first lip wall and including a plurality of teeth orthogonally extending therefrom.

15. The sealing assembly of claim 8, wherein said lip further includes first and second walls, said first lip wall being substantially parallel to said body portion and including a plurality of nodes extending therefrom, said second lip wall being substantially perpendicular to said first lip wall and including a tooth for engaging a recessed edge of said drain plate.

16. The sealing assembly of claim 8, wherein said lip further includes a rear wall adapted to engage a back side of said drain plate, said rear wall including:

a first sealing member adapted to axially project from said rear wall opposite said drain plate, said first sealing member being adapted to substantially span a diameter of said drain plate;

a second sealing member axially projecting from said rear wall and extending from said first sealing member, said second sealing member complimenting a curve of said lip;

a first recessed portion between said first and second sealing members, said first recessed portion being adapted to engage said drain plate to secure said sealing assembly to said drain plate; and a second recessed portion between said second sealing member and said lip.

17. The sealing assembly of claim 16, wherein said lip is bifurcated at an end into a pair of spaced apart fingers adapted to secure said sealing assembly to said drain plate.

18. The sealing assembly of claim 8, wherein said assembly further comprises:

an extension member including a bypass opening and a channel adapted to fluidly communicate with said overflow opening formed in said drain plate; and a base portion being coupled to said extension member and adapted to substantially prevent any fluid communication through said overflow opening formed in said drain plate.

19. The sealing assembly of claim 18, wherein said bypass opening is adapted to be located at a height greater than said overflow opening formed in said drain plate.

20. A bath tub comprising:

a floor;

a wall projecting from said floor;

said wall including a drain opening formed therein;

a plate coupled to said wall to cover said drain opening, said plate including a base having an annular skirt axially projecting therefrom and sealingly engaging said wall, said annular skirt including a recessed edge forming an overflow opening fluidly communicating with said drain opening; and a sealing member sealingly engaging said wall and said plate to prevent fluid flow into said overflow and drain openings, said sealing member including an arcuate lip engaging said recessed edge, a radiused side wall engaging said skirt, and a body engaging said base.

* * * * *